United States Patent [19]

Zinnbauer

[11] Patent Number: 4,723,858

[45] Date of Patent: Feb. 9, 1988

[54] SOLID DEODORANT DISPENSING PACKAGE

[76] Inventor: Gerald B. Zinnbauer, Grand Traverse Design, P.O. Box 40480, Bay Village, Ohio 44140-0480

[21] Appl. No.: 915,361

[22] Filed: Oct. 6, 1986

[51] Int. Cl.[4] ..... A45D 39/04

[52] U.S. Cl. ..... 401/60; 206/823

[58] Field of Search ..... 401/60, 59; 206/385, 206/823, 817

[56] References Cited

U.S. PATENT DOCUMENTS 2,453,250 11/1948 Nehrke ..... 401/60

FOREIGN PATENT DOCUMENTS 2494230 5/1982 France ..... 401/60

*Primary Examiner*—Joseph J. Rolla
*Assistant Examiner*—Kenneth Noland

[57] ABSTRACT

A solid deodorant dispensing package that includes a container, a solid deodorant holding cup which is movable in a cavity in the container between a dispensing position in which a portion of the solid deodorant extends through an opening in the periphery of the container and a storage position in which such portion of the solid deodorant is entirely contained within the container, and an elongate flexible closure which is movable within tracks in the container between a closed position in which a portion of the elongate flexible closure closes the opening in the periphery of the container and an opened position in which the elongate flexible closure does not close the opening, an end of the elongate closure being attached to the solid deodorant holding cup so that the movement of the elongate flexible closure from the closed position to the opened position moves the holding cup from the storage position to the dispensing position, and vice versa. The container is made up of a pair of molded plastic mirror image members, each of which is partially surrounded by a flange, the pair of members being joined to one another by heat sealing with the edges of the flanges of the members lying in edge-to-edge relationship with one another. The holding cup and the elongate flexible closure are integrally formed in a single molded plastic combined member.

19 Claims, 8 Drawing Figures

FIG. 1
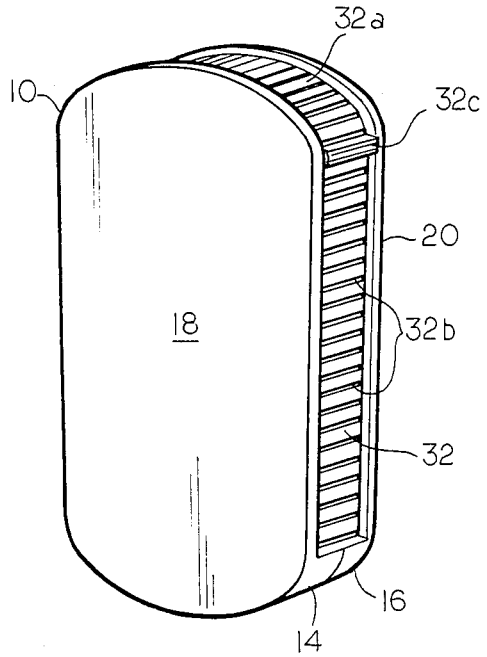
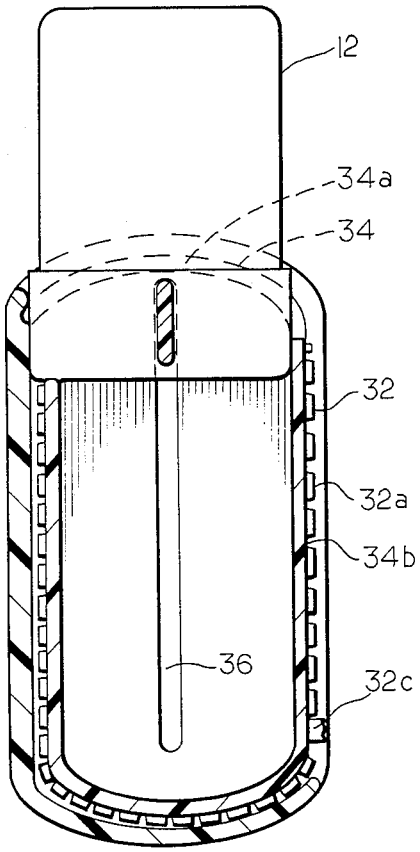
FIG. 6
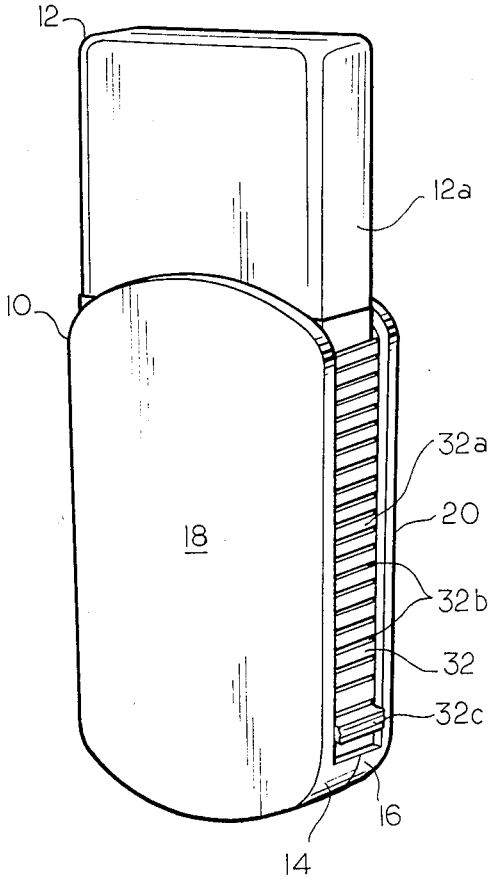
FIG. 2

SOLID DEODORANT DISPENSING PACKAGE

BACKGROUND OF THE INVENTION

1. Field of the Invention

This invention relates to a package that includes a solid deodorant and a container for enclosing the solid deodorant during times when it is not desired to use the solid deodorant and for dispensing the deodorant when it is desired to use the solid deodorant, upon the opening of the package.

2. Background of the Prior Art

Various types of packages for the packaging and dispensing of solid deodorants are known in the prior art, both for solid deodorants in cylindrical or rod form and for solid deodorants in slab or cake form. Such packages usually include a container, a separate closure which is removable from the container to permit access to the solid deodorant and which can be reapplied to the container after the use of the solid deodorant, and a mechanism for raising and lowering the solid deodorant within the container to present it in a proper position for use and to then retract it to a proper position for storage. In these various types of packages, the raising and lowering mechanism cannot be actuated to raise the solid deodorant to its dispensing or use position until after the closure of the package has been removed, and it must be actuated to lower the solid deodorant to its storage position before the closure can be reapplied to the container. Further, in many of these types of solid deodorant dispensing packages, the closure and the container are separate pieces and are subject to disassociation from one another upon the removal of the closure from the container, as by the loss of the closure, in which case the package cannot be properly reclosed.

SUMMARY OF THE INVENTION

According to the present invention there is provided a dispensing package for the packaging and dispensing of a solid deodorant in cake or generally parallelepiped form, the package being made up of such solid deodorant, a container therefor, and a combined solid deodorant holding cup and container closure for elevating the holding cup and the solid deodorant upon the opening of the container to present the solid deodorant for dispensing, in a single action, and for retracting the solid deodorant within the container upon the closing of the container, again, in a single action. The container is made up of opposed side members which have complemental recesses opposing one another to define a cavity that contains the solid deodorant in cake form and the holding cup portion of the combined holding cup and closure.

The dispensing closure portion of the combined holding cup and closure is in the form of an elongate flexible member, an end of which is attached to the holding cup. Each of the opposed side members of the container has an elongate, partly curvilinear recess therein, and the elongate partly curvilinear recesses of the opposed side portions are opposed to one another and form opposed tracks in which the opposed edges of the elongate flexible member travel to permit the elongate flexible member to be manually moved back and forth within such opposed tracks to permit the opening or closing of the dispensing package. By virtue of the attachment of the elongate flexible member to the solid deodorant holding cup, the movement of the elongate flexible member within the opposed tracks to open the dispensing package is effective to elevate the holding cup to present a portion of the solid deodorant held therein at a suitable position for dispensing or use beyond the limits of the container through an opening therein that is uncovered by the movement of the elongate flexible member, and upon the reverse movement of the elongate flexible member, all portions of the solid deodorant are retracted through such opening in the container by the retraction of the holding cup, before the opening is recovered by the portion of the elongate flexible member that normally covers such opening in the fully closed package.

Each of the opposed side members of the container has a flange portion which extends inwardly therefrom around a portion of the periphery thereof, a portion which is not to be uncovered upon the opening of the package or which must be left open for access to the closure portion of the combined holding cup and closure to permit its movement between its position when the container is opened and its position when the container is closed. After the assembly of the various elements of the package, viz., the solid deodorant within the holding cup of the combined holding cup and container closure, and the combined holding cup, with solid deodorant therein, and container closure within the cavity defined by the opposed side members so that the opposed edges of the elongate flexible member of the closure portion of the combined holding cup and container closure are engaged in the opposed tracks in the opposed side members, the opposed side members are permanently secured in position by securing the edge of the flange portion of one of the side members to the edge of the flange portion of the other side member. The side members are, preferably, formed by injection molding from suitable thermoplastic materials, such as polystyrene, or modifications thereof, and the edges of the flange portions of the side portions of the container, when the side members are formed any of such thermoplastic materials, can be readily joined to one another in any of a variety of known ways, including by the use of an adhesive, such as a hot melt or a heat activatable adhesive or by heat sealing, for example, by heat that is developed ultrasonically.

The combined holding cup and container closure of the present invention is, preferably, also formed by injection molding from a suitable thermoplastic material, such as high density polyethylene or polypropylene or modifications of such materials, or from flexible modifications of polystyrene such as modifications of the butadiene-styrene type and this item is preferably formed in a single piece, with the holding cup portion thereof and the elongate flexible member of the closure portion thereof being integral with one another. To impart suitable flexibility to the elongate flexible member, so that it can travel in an irregular path with a curvilinear portion, it is provided with a series of spaced apart, thinned portions extending transversely thereacross, each such thinned portion serving as a hinge to permit flexing of the portions on opposite sides of such thinned portion relative to one another. In appearance and function, then, the elongate flexible member has certain similarities to the cover of a roll-top type of desk.

Accordingly, it is an object of the present invention to provide an improved solid deodorant dispensing package. It is a further object of the present invention to provide a solid deodorant dispensing package having container and closure elements, in which the container and closure elements are not subject to disassociation from one another upon the opening of the package to help to ensure that the package can always be properly reclosed. It is yet another object of the present invention to provide a solid deodorant dispensing package having a container and closure element in which the movement of the closure relative to the container to open the container actuates the raising of the solid deodorant within the container to present the solid deodorant at a suitable position for dispensing or use, without the need for a separate actuating motion or the need for a separate actuating device to effect such raising of the solid deodorant, and it is a corollary object of the present invention to provide a solid deodorant dispensing package of the aforesaid type in which the movement of the closure relative to the container actuates the lowering of the solid deodorant within the container to a suitable position for storage therein. It is also an object of the present invention to provide a solid deodorant dispensing package having container and closure elements which can be readily produced in large quantities from suitable and relatively inexpensive thermoplastic materials by conventional types of molding techniques and equipment. It is yet another object of the present invention to provide a solid deodorant dispensing package which can be mass produced at a relatively low cost, and in an aesthetically pleasing color, texture and shape, and which can be readily and relatively inexpensively enhanced in its appearance by the application of printing or decorative material thereto by conventional types of printing or decorating techniques, equipment, and materials.

For a further understanding of the present invention and the objects thereof, attention is directed to the drawings and the following brief description thereof, to the detailed description of the preferred embodiment and to the appended claims.

BRIEF DESCRIPTION OF THE DRAWING

FIG. 1 is a perspective view of a solid deodorant dispensing package according to the present invention in its closed or non-dispensing condition;

FIG. 2 is a view similar to FIG. 1 in which the solid deodorant dispensing package is shown in its opened or dispensing condition with a cake of solid deodorant extending therefrom;

FIG. 6 is a view similar to FIG. 5 in which the solid deodorant dispensing package is shown in its opened or dispensing condition;

DETAILED DESCRIPTION OF THE PREFERRED EMBODIMENT

Figure 3:
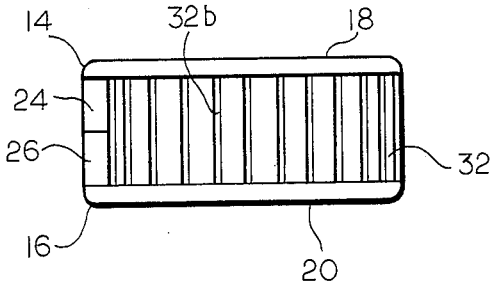
FIG. 3 is a plan view of the solid deodorant dispensing package according to the present invention in the condition illustrated in FIG. 1.

A solid deodorant dispensing package according to the present invention has a container 10 and, as is shown in FIG. 2, the container 10, upon the opening thereof as hereinafter described, contains a solid deodorant 12 in the form of cake or, more precisely, generally in the shape of a parallelepiped. The solid deodorant 12 can be raised or lowered with respect to the container 10, as hereinafter described, to be retracted entirely within the outline of the container 10, as is shown in FIG. 1, or to present a portion **12*a* of the solid deodorant 12 in a dispensing or use position beyond the outline of the container 10, as is shown in FIG. 2**.

The container 10 is made up of first and second members 14 and 16, respectively. The first member 14 of the container 10 has a generally flat, planar portion 18 and the second member 16 of the container 10 has a generally flat, planar portion 20. The planar portion 18 and the planar portion 20 are spaced apart from one another and partially serve, together with other portions of the first and second members, to define a cavity 22 (FIG. 5) within the container 10 for receiving the solid deodorant 12.

Figure 4:
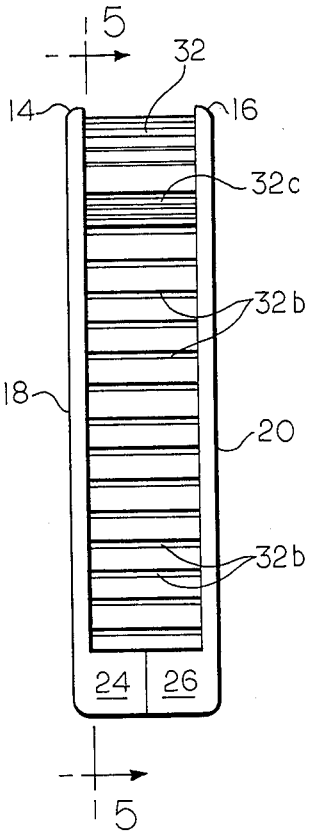
FIG. 4 is an elevational view of the solid deodorant dispensing package according to the present invention in the condition illustrated in FIG. 1.
Figure 8:
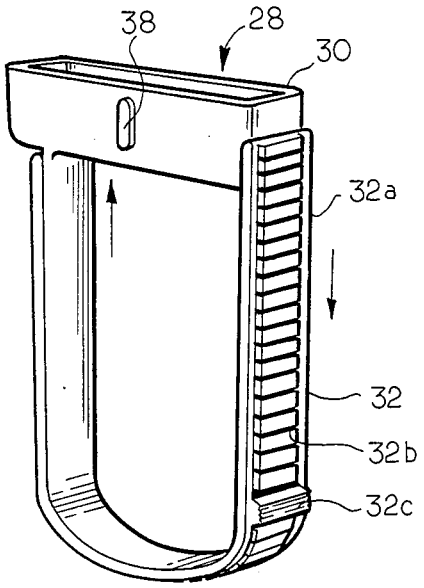
FIG. 8 is a perspective view of the combined holding cup and closure of the solid deodorant dispensing package of FIGS. 1 through 6.
Figure 7:
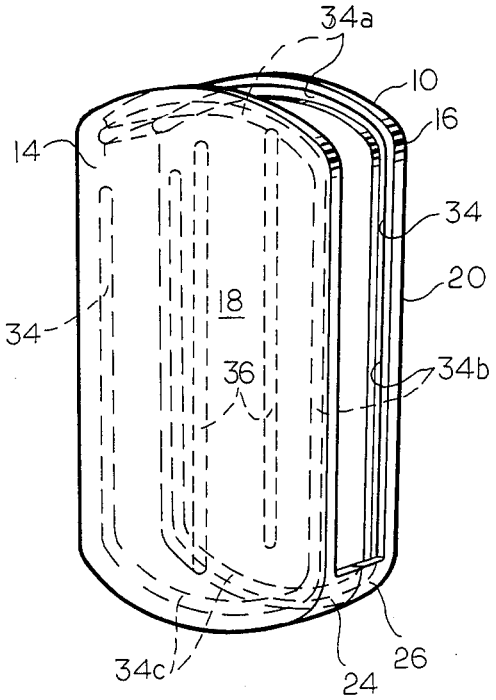
FIG. 7 is a perspective view of the container element of the solid deodorant dispensing package of FIGS. 1 through 6.

The first member 14 has a flange 24 which extends transversely therefrom toward the second member 16, the flange 24 extending from the periphery of the first member 14 and having a lineal extent which is substantially less than the periphery of the first member, and preferably slightly greater than one-half of the periphery of the first member, as can be seen from the showing of the flange 24 in FIGS. 3 and 4 of the drawing. Similarly, the second member 16 has a flange 26 which extends transversely therefrom, the flange 26 extending from the periphery of the second member 16 and having a lineal extent which is substantially less than the periphery of the second member, and preferably slightly greater than one-half of the periphery of the second member, as can be seen from the showing of the flange 26 in FIGS. 3 and 4 of the drawing.

The first member 14 and the second member 16 are mirror images of one another, and the flange 24 of the first member 14 and the flange 26 of the second member 16 abut one another and are coextensive with one another when the first member 14 and the second member 16 are brought into juxtaposed positions with respect to one another. Thus, when the first member 14 and the second member 16 are so juxtaposed, they are permanently secured to one another by bonding the abutting edges of the flanges 24 and 26 to one another.

The first member 14 and the second member 16 are preferably formed from thermoplastic materials, such as polystrene or modifications of polystyrene such as modifications of the butadiene-styrene type, and when the first and second members 14 and 16 are formed from any of such materials, they may be mass produced relatively inexpensively by conventional molding processes and equipment, such as by injection molding. When formed from any of such thermoplastic materials by injection molding, the first and second members can be provided with good rigidity, precisely formed dimensions, mechanical and chemical durability, and strength for the packaging of a solid deodorant and they can be provided with an aesthetically pleasing shape, coloration and texture, factors which are important in a product that is to be sold in large quantities to consumers.

Additionally, when the first and second members 14 and 16 are formed any of such thermoplastic materials, they can be attractively decorated with printing or other decorative material by conventional printing processes and equipment and using conventional and attractive printing inks.

When the first and second members 14 and 16 are formed from a thermoplastic material, they may be readily and relatively inexpensively permanently secured to one another by heat sealing the abutting edges of the flanges 24 and 26 of one another. The necessary heating of the edges of the flanges 24 and 26 can be developed ultrasonically, by a conventional technique. Alternatively, the sealing may be accomplished through an adhesive which is chemically compatible with the material of the first and second members 14 and 16, such as a hot melt adhesive or a heat activatable adhesive, as is known in the art. It is also contemplated that the first and second members can be joined together mechanically by a snap-fit or the like.

In addition to the first and second members 14 and 16, the container 10 also includes a combined member, shown generally by reference numeral 28, that is made up of a holding cup 30 and a closure 32 in the form of an elongate flexible member, one end of which is attached to the holding cup 30. Preferably, the holding cup 30 and the closure 32 of the combined member 28 are formed integrally, and this may be readily and relatively inexpensively accomplished by injection molding the combined member 28 from a suitable thermoplastic material, such as high density polyethylene or polypropylene or modifications of such materials. Since injection molded thermoplastic products can be formed in a variety of attractive colors by the addition of any of a variety of colorant materials to the thermoplastic resin used in the injection molding process, as is known in the art, the combined member 28 can either be formed in the same color as the first and second members 14 and 16, or it can be formed in a different color than the first and second members 14 and 16. By a careful selection of a first color for the first and second members 14 and 16, for example, white, and a second color for the combined member 28, for example, green, an especially attractive appearance can be imparted to the container 10.

Each of the first and second members 14 and 16 is provided with a partial depth lineal groove 34 on the inside of and proximate to the perimeters of the planar portions 18 and 20 thereof, the lineal groove 34 on the inside of the planar portion 20 of the second member 16 generally occupying the portion of the perimeter of the second member 16 that is not occupied by the flange 26 as well as a portion of the perimeter of the second member 16 that is occupied by the flange 26. Similarly, the lineal groove, not shown, on the inside of the planar portion 18 of the first member 14 generally occupies the portion of the perimeter of the first member 14 that is not occupied by the flange 24 as well as a portion of the perimeter of the first member 14 that is occupied by the flange 24. In any case, the opposite edges of the closure 32 are trapped in the lineal grooves which include the lineal groove 34 and the closure 32 can be slid back and forth in the lineal grooves from a position, shown in FIGS. 1 and 5, in which an end portion **32*a* of the closure 32 closes the upper end of the container 10 to a position, shown in FIGS. 2 and 6, in which the end portion 32*a* of the closure 32 extends along the side of the container to open the upper end of the container 10 for access to the solid deodorant 12, which is contained in the holding cup 30 of the combined member 28**.

To provide a suitable path of travel to the closure 32, each of the grooves 34 is provided with a curvilinear portion **34*a* near the upper end of the container 10, a rectilinear portion 34*b* along the side of the container 10 and a curvilinear portion 34*c* near the bottom of the container 10. To accommodate the necessary bending of the closure 32 as it moves within the curvilinear portions 34*a* and 34*c* of the grooves 34, the closure 32 is provided with multiple spaced apart thinned portions 32*b*, each of which acts as a hinge to permit flexing or bending of the portions of the closure on opposite sides of each such thinned portion 32*b* relative to one another. Additionally, to facilitate the manual movement of the closure 32, it is advantageously provided with an outwardly projecting tab portion 32*c***.

Figure 5:
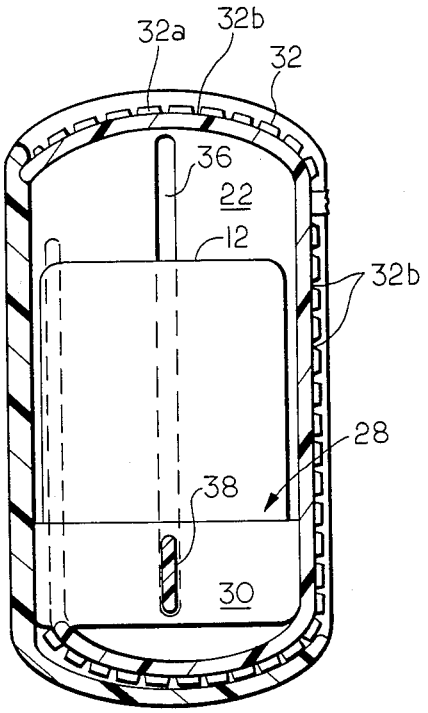
FIG. 5 is a sectional view taken along lines 5—5 of FIG. 4.

By virtue of the engagement of the closure 32 with the underside of the holding cup 30 in the combined member 28, the movement of the closure 32 from the closed position, as shown in FIGS. 1 and 5, to the open position, as shown in FIGS. 2 and 6, is effective to elevate the holding cup 30 from the storage position to the dispensing position. Similarly, the return of the closure 32 from the open position to the closed position is effective to retract the holding cup 30 from the dispensing position to the closed position. On the opening of the container 10, the holding cup 30 starts to rise immediately upon the movement of the closure 32. Thus, a clearance space is provided between the top of the solid deodorant 12 and the underside of the end portion **32*a* of the closure 32 to avoid interference between the top of the solid deodorant 12 and the underside of the end portion 32*a* of the closure 32, to thereby permit the end portion 32*a* to be retracted from the top of the container 10 before the top of the solid deodorant 12 reaches the curvilinear portion 34*a* of the lineal groove 34**.

To help guide the movement of the holding cup 30 within the cavity 22, at least one and preferably both of the first and second members 14 and 16 is provided with a partial depth vertical groove, such as the vertical groove 36, on the inside of the planar portion 20 of the second member 16, and the holding cup 30 is provided with an outwardly projecting tab 38 which is trapped within the vertical groove 36 for reciprocating motion therein.

Having, thus, described the present invention by way of an exemplary embodiment, it will be apparent to those skilled in the art that many modifications may be made from the exemplary embodiment without departing from the spirit of the present invention or the scope of the claims appended thereto.

What is claimed is:

1. A solid deodorant dispensing package comprising:

a container, said container having:

first wall means having an inside, an outside, a periphery and a track on said inside of said first wall means, said track being adjacent to said periphery of said first wall means and extending around a first portion of said first wall means, said first portion representing less than the entirety of said periphery of said first wall means;

second wall means having an inside, an outside, a periphery and a track on said inside of said second wall means, said track on said inside of said second wall means being adjacent to said periphery of said second wall means and extending around a first portion of said second wall means, said first portion of said second wall means representing less than the entirety of said periphery of said second wall means, said second wall means being spaced apart from said first wall means and defining a space therebetween; and flange means extending between said first wall means and said second wall means, said flange means being attached to said first wall means and to said second wall means and extending around and enclosing a second portion of said periphery of said first wall means and a second portion of said periphery of said second wall means, at least a substantial portion of said first portion of said periphery of said first wall means and at least a substantial portion of said periphery of said second wall means lying outside said second portion of said periphery of said first wall means and said second portion of said periphery of said second wall means, respectively, said at least a substantial portion of said first portion of said periphery of said first wall means and said at least a substantial portion of said first portion of said periphery of said second wall means defining an opening for dispensing a solid deodorant;

a cup for holding a solid deodorant, said cup being positioned in said space between said first wall means and said second wall means, and being movable in said space between a dispensing position adjacent said opening and a storage position away from said opening;

a solid deodorant having a first portion contained within said cup and a second portion that extends away from said cup, at least a portion of said second portion of said solid deodorant extending through said opening when said cup is in said dispensing position, said at least a portion of said second portion of said solid deodorant being contained within said space when said cup is in said storage position; and an elongate flexible closure having opposed edges and first and second ends, said cup and said elongate flexible closure being formed integrally with one another by injection molding, one of said opposed edges of said elongate flexible closure being reciprocably engaged in said track on said inside of said first wall means, the other of said opposed edges of said elongate flexible closure being reciprocably engaged in said track on said inside of said second wall means, said closure being reciprocable between a closed position in which a portion of said closure adjacent one of said first and second ends closes said opening and an opened position in which said portion of said closure is retracted away from said opening, the other of said first and second ends of said closure being attached to said cup, whereby the movement of said closure from said closed position to said opened position moves said cup from said storage position to said dispensing position and the movement of said closure from said opened position to said closed position moves said cup from said dispensing position to said storage position, said elongate flexible closure comprising a plurality of spaced apart thinned portions extending thereacross to facilitate the flexing of said elongate flexible closure.

2. A solid deodorant dispensing package according to claim 1 wherein said cup and said elongate flexible closure are formed integrally with one another.

3. A solid deodorant dispensing package according to claim 1 wherein said elongate flexible closure comprises a tab portion projecting outwardly therefrom to facilitate the manual movement of said elongate flexible closure.

4. A solid deodorant dispensing package according to claim 1 wherein said thermoplastic material is selected from the group consisting of high density polyethylene, polypropylene, modifications of high density polyethylene, and modifications of polypropylene.

5. A solid deodorant dispensing package comprising:

a container, said container having:

first wall means having an inside, an outside, a periphery and a track on said inside of said first wall means, said track being adjacent to said periphery of said first wall means and extending around a first portion of said first wall means, said first portion representing less than the entirety of said periphery of said first wall means;

second wall means having an inside, an outside, a periphery and a track on said inside of said second wall means, said track on said inside of said second wall means being adjacent to said periphery of said second wall means and extending around a first portion of said second wall means, said first portion of said second wall means representing less than the entirety of said periphery of said second wall means, said second wall means being spaced apart from said first wall means and defining a space therebetween; and flange means extending between said first wall means and said second wall means, said flange means being attached to said first wall means and to said second wall means and extending around and enclosing a second portion of said periphery of said first wall means and a second portion of said periphery of said second wall means, at least a substantial portion of said first portion of said periphery of said first wall means and at least a substantial portion of said first portion of said periphery of said second wall means lying outside said second portion of said periphery of said first wall means and said second portion of said periphery of said second wall means, respectively, said at least a substantial portion of said first portion of said periphery of said first wall means and said at least a substantial portion of said first portion of said periphery of said second wall means defining an opening for dispensing a solid deodorant;

a cup for holding a solid deodorant, said cup being positioned in said space between said first wall means and said second wall means and being movable in said space between a dispensing position adjacent said opening and a storage position away from said opening, said cup comprising a tab extending outwardly therefrom;

a solid deodorant having a first portion contained within said cup and a second portion that extends away from said cup, at least a portion of said second portion of said solid deodorant extending through said opening when said cup is in said dispensing position, said at least a portion of said second portion of said solid deodorant being contained within said space when said cup is in said storage position; and an elongate flexible closure having opposed edges and first and second ends, one of said opposed edges of said elongate flexible closure being reciprocably engaged in said track on said inside of said first wall means, the other of said opposesd edges of said elongate flexible closure being reciprocably engaged in said track on said inside of said second wall means, said closure being reciprocable between a closed position in which a portion of said closure adjacent one of said first and second ends closes said opening and an opened position in which said portion of said closure is retracted away from said opening, the other of said first and second ends of said closure being attached to said cup, whereby the movement of said closure from said closed position to said opened position moves said cup from said storage position to said dispensing position and the movement of said closure from said opened position to said closed position moves said cup from said dispensing position to said storage position;

one of said first wall means and said second wall means of said container having a rectilinear track on the inside thereof, said rectilinear track extending parallel to the direction of movement of said cup in said space, said tab of said cup being engaged in said rectilinear track to guide the movement of said cup in said space.

6. A solid deodorant dispensing package according to claim 5 wherein the other of said first wall means and said second wall means has a second rectilinear track on the inside thereof, said second rectilinear track extending parallel to the direction of movement of said cup in said space, and wherein said cup further comprises a second tab extending outwardly therefrom, said second tab being engaged within said second rectilinear track to further guide the movement of said cup in said space.

7. A solid deodorant dispensing package comprising:

a container, said container comprising:

a first member, said first member having a first generally planar portion with an inside, an outside, a periphery and a track on said inside of said first generally planar portion, said track being adjacent to said periphery of said first generally planar portion and extending around a first portion of said first generally planar portion, said first portion of said first generally planar portion representing less than the entirety of said periphery of said first generally planar portion, said first member further having first flange means with an edge, said first flange means being attached to and projecting away from said inside of said first generally planar portion, said first flange means extending around and enclosing a second portion of said periphery of said first generally planar portion, at least a substantial portion of said first portion of said periphery of said first generally planar portion lying outside said second portion of said periphery of said first generally planar portion; and a second member disposed adjacent to said first member, said second member having a second generally planar portion with an inside, an outside, a periphery and a second track on said inside of said second generally planar portion, said second track being adjacent to said periphery of said second generally planar portion and extending around a first portion of said second generally planar portion, said first portion of said second generally planar portion representing less than the entirety of said periphery of said second generally planar portion, said second generally planar portion being spaced apart from said first generally planar portion and defining a space therebetween, said inside of said first generally planar portion and said inside of said second generally planar portion facing toward one another, said second member further having second flange means with an edge, said second flange means being attached to and projecting away from said inside of said second generally planar portion, said second flange means extending around and enclosing a second portion of said periphery of said second generally planar portion, at least a substantial portion of said first portion of said periphery of said second generally planar portion lying outside said second portion of said, periphery of said second generally planar portion, said first portion of said periphery of said first generally planar portion and said first portion of said periphery of said second generally planar portion defining an opening for dispensing a solid deodorant, said second flange means of said second member being secured to said first flange means of said first member;

a cup for holding a solid deodorant, said cup being positioned in said space between said first generally planar portion and said second generally planar portion and being movable in said space between a dispensing position adjacent said opening and a storage position away from said opening, said cup comprising a tab extending outwardly therefrom;

a solid deodorant having a first portion contained within said cup and a second portion that extends away from said cup, at least a portion of said second portion of said solid deodorant extending through said opening when said cup is in said dispensing position, said at least a portion of said second portion of said solid deodorant being contained within said space when said cup is in said storage position; and an elongate flexible closure having opposed edges and first and second ends, one of said opposed edges of said elongate flexible closure being reciprocably engaged in said first track, the other of said opposed edges of said elongate flexible closure being reciprocably engaged in said second track, said closure being reciprocable between a closed position in which a portion of said closure adjacent one of said first and second ends closes said opening and an opened position in which said portion of said closure is retracted away from said opening, the other of said first and second ends of said closure being attached to said cup, whereby the movement of said closure from said closed position to said opened position moves said cup from said storage position to said dispensing position and the movement of said closure from said opened position to said closed position moves said cup from said dispensing position to said storage position;

one of said first generally planar portion and said second generally planar portion having a rectilinear track on the inside thereof, said rectilinear track extending parallel to the direction of movement of said cup in said space, said tab of said cup being engaged within said rectilinear track to guide the movement of said cup in said space.

8. A solid deodorant dispensing package according to claim 7 wherein said second flange means is secured to said first flange means with said edge of said second flange means and said edge of said first flange means in abutting relationship with one another.

9. A solid deodorant dispensing package according to claim 8 wherein each of said first member and said second member of said container is formed from a first thermoplastic material by injection molding.

10. A solid deodorant dispensing package according to claim 9 wherein said second flange means is secured to said first flange means by heat sealing.

11. A solid deodorant dispensing package according to claim 9 wherein said first thermoplastic material is selected from the group consisting of polystyrene and modifications of polyestyrene.

12. A solid deodorant dispensing package according to claim 7 wherein said first member has a configuration, wherein said second member has a configuration, and wherein said configuration of said second member is substantially that of a mirror image of said configuration of said first member.

13. A solid deodorant dispensing package according to claim 12 wherein the other of said first generally planar portion and said second generally planar portion has a rectilinear track which is on the inside thereof and which extends parallel to the direction of movement of said cup in said space and wherein said cup further comprises a and second tab extending outwardly therefrom, said second tab being engaged within said second rectilinear track to further guide the movement of said cup within said space.

14. A solid deodorant dispensing package according to claim 7 wherein the other of said first generally planar portion and said second generally planar portion has a second rectilinear track on the inside thereof, said second rectilinear track extending parallel to the direction of movement of said cup in said space, and wherein said cup further comprises a second tab extending outwardly therefrom, said second tab being engaged within said second rectilinear track to further guide the movement of said cup in said space.

15. A solid deodorant dispensing package according to claim 7 wherein said cup and said elongate flexible closure are formed integrally with one another from a second thermoplastic material by injection molding.

16. A solid deodorant dispensing package according to claim 15 wherein first thermoplastic material has a first color, wherein said second thermoplastic material has a second color and wherein said second color is different than said first color and harmonious with said first color.

17. A solid deodorant dispensing package according to claim 15 wherein said second thermoplastic material is selected from the group consisting of high density polyethylene, polypropylene, modifications of high density polyethylene, modifications of polypropylene, and flexible modifications of polystyrene.

18. A solid deodorant dispensing package comprising:

a container, said container comprising:

a first member, said first member having a first generally planar portion with an inside, an outside, a periphery and a track on said inside of said first generally planar portion, said track being adjacent to said periphery of said first generally planar portion and extending around a first portion of said first generally planar portion, said first portion of said first generally planar portion representing less than the entirety of said periphery of said first generally planar portion, said first member further having first flange means with an edge, said first flange means being attached to and projecting away from said inside of said first generally planar portion, said first flange means extending around and enclosing a second portion of said periphery of said first generally planar portion, at least a substantial portion of said first portion of said periphery of said first generally planar portion lying outside said second portion of said periphery of said first generally planar portion; and a second member disposed adjacent to said first member, said second member having a second generally planar portion with an inside, an outside, a periphery and a second track on said inside of said second generally planar portion, said second track being adjacent to said periphery of said second generally planar portion and extending around a first portion of said second generally planar portion, said first portion of said second generally planar portion representing less than the entirety of said periphery of said second generally planar portion, said second generally planar portion being spaced apart from said first generally planar portion and defining a space therebetween, said inside of said first generally planar portion and said inside of said second generally planar portion facing toward one another, said second member further having second flange means with an edge, said second flange means being attached to and projecting away from said inside of said second generally planar portion, said second flange means extending around and enclosing a second portion of said periphery of said second generally planar portion, at least a substantial portion of said first portion of said periphery of said second generally planar portion lying outside said second portion of said periphery of said second generally planar portion, said first portion of said periphery of said first generally planar portion and said first portion of said periphery of said second generally planar portion defining an opening for dispensing a solid deodorant, said second flange means of said second member being secured to said first flange means of said first member;

a cup for holding a solid deodorant, said cup being positioned in said space between said first generally planar portion and said second generally planar portion, said cup being movable in said space between a dispensing position adjacent said opening and a storage position away from said opening;

a solid deodorant having a first portion contained within said cup and a second portion that extends away from said cup, at least a portion of said second portion of said solid deodorant extending through said opening when said cup is in said dispensing position, said at least a portion of said second portion of said solid deodorant being contained within said space when said cup is in said storage position; and an elongate flexible closure having opposed edges and first and second ends, one of said opposed edges of said elongate flexible closure being reciprocably engaged in said first track, the other of said opposed edges of said elongate flexible closure being reciprocably engaged in said second track, said closure being reciprocable between a closed position in which a portion of said closure adjacent one of said first and second ends closes said opening and an opened position in which said portion of said closure is retracted away from said opening, the other of said first and second ends of said closure being attached to said cup, whereby the movement of said closure from said closed position to said opened position moves said cup from said storage position to said dispensing position and the movement of said closure from said opened position to said closed position moves said cup from said dispensing position to said storage position, said elongate flexible closure comprising a plurality of thinned portions extending thereacross to facilitate the flexing of said elongate flexible closure.

19. A solid deodorant dispensing package according to claim 18 wherein said elongate flexible closure comprises a tab portion projecting outwardly therefrom to facilitate the manual movement of said elongate flexible closure.

* * * * *